US008622513B2

(12) United States Patent
Steurrys et al.

(10) Patent No.: US 8,622,513 B2
(45) Date of Patent: Jan. 7, 2014

(54) USING LOW PRESSURE ASSIST (LPA) TO ENABLE PRINTHEAD MAINTENANCE SYSTEM SIMPLIFICATION

(75) Inventors: Christine A. Steurrys, Williamson, NY (US); Kaitlin M. Tomeo, Vernon, CT (US); Paul A. Hosier, Rochester, NY (US); Michael Lu, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 462 days.

(21) Appl. No.: 13/088,797

(22) Filed: Apr. 18, 2011

(65) Prior Publication Data

US 2012/0262508 A1 Oct. 18, 2012

(51) Int. Cl.
*B41J 2/165* (2006.01)
*B41J 29/38* (2006.01)

(52) U.S. Cl.
USPC ..... 347/33; 347/6; 347/17

(58) Field of Classification Search
USPC ..... 347/33, 6, 17, 29, 35, 36, 88, 19, 103
See application file for complete search history.

(56) References Cited

U.S. PATENT DOCUMENTS 5,644,347 A * 7/1997 Schwiebert et al. ..... 347/33
5,694,157 A * 12/1997 Ahlvin ..... 347/24
5,786,830 A * 7/1998 Su et al. ..... 347/33
5,898,445 A * 4/1999 Becker et al. ..... 347/33
6,139,136 A * 10/2000 Mackay et al. ..... 347/85
6,164,752 A 12/2000 Schaefer et al.
6,460,968 B1 * 10/2002 Chee et al. ..... 347/33
6,585,350 B2 * 7/2003 Barinaga ..... 347/33
6,595,619 B2 * 7/2003 Barinaga et al. ..... 347/32
6,761,428 B2 * 7/2004 Agarwal et al. ..... 347/33
6,893,110 B2 * 5/2005 Plymale et al. ..... 347/33
2005/0146572 A1 * 7/2005 Hill et al. ..... 347/85
2008/0049066 A1 * 2/2008 Inoue ..... 347/33
2009/0231378 A1 9/2009 Snyder et al.
2010/0271423 A1 10/2010 Snyder et al.
2010/0271424 A1 10/2010 Cunnington et al.
2011/0025755 A1 * 2/2011 Rosati et al. ..... 347/29
2011/0025802 A1 * 2/2011 Rosati et al. ..... 347/104

* cited by examiner

*Primary Examiner* — Laura Martin
*Assistant Examiner* — Leonard S Liang
(74) *Attorney, Agent, or Firm* — Maginot, Moore & Beck, LLP

(57) ABSTRACT

A method of performing maintenance on printheads of an imaging device includes the detection of at least one missing or defective inkjet in a printhead. A first pressure is applied to ink in printheads in which at least one missing or defective inkjet was detected. The first pressure is configured to discharge ink from the plurality of apertures in an aperture plate of the printhead to reestablish fluid continuity through the inkjet. A second pressure is applied to all of the printheads to be wiped. The second pressure is configured to form a convex meniscus at the plurality of apertures in the aperture plate of all of the printheads to be wiped. A single actuator is then operated to move one or more wipers into engagement with the printheads to be wiped. During wiping the convex meniscus is encountered by a wiper to lubricate a printhead and prevent the printhead from being damaged by wiping. The single actuator then retracts the one or more wipers from the printheads.

18 Claims, 6 Drawing Sheets

USING LOW PRESSURE ASSIST (LPA) TO ENABLE PRINTHEAD MAINTENANCE SYSTEM SIMPLIFICATION

TECHNICAL FIELD

This disclosure relates generally to printheads of an inkjet imaging device, and, in particular, to maintenance methods for use with such printheads.

BACKGROUND

Solid ink or phase change ink printers conventionally receive ink in a solid form, which in some printers is referred to as solid ink sticks and in other printers, solid ink pastilles are used. The solid ink forms are typically inserted through an insertion opening of an ink loader for the printer and are moved by a feed mechanism and/or gravity toward a heater plate. The heater plate melts the solid ink impinging on the plate into a liquid that is delivered to a printhead assembly for jetting onto a recording medium. In the direct printing architecture, the recording medium is typically paper, while for an offset printing architecture, the ink is printed onto a liquid layer supported by an intermediate imaging member, such as a metal drum or belt.

A printhead assembly of a phase change ink printer typically includes one or more printheads each having a plurality of inkjets from which drops of melted solid ink are ejected towards the recording medium. The inkjets of a printhead receive the melted ink from an ink supply chamber, or manifold, in the printhead which, in turn, receives ink from a source, such as a melted ink reservoir or an ink cartridge. Each inkjet includes a pressure chamber that is fluidly connected to the manifold to receive ink The pressure chamber is aligned with an actuator and a diaphragm is disposed between the actuator and the pressure chamber. The pressure chamber is also fluidly connected through a channel to an aperture in an aperture plate. During printing, firing signals activate the actuators, which expand and distend the diaphragm into the pressure chamber. This action propels ink from the pressure chamber through the channel to an aperture where a drop of ink is expelled onto the recording medium. By selectively activating the actuators of the inkjets to eject drops as the recording medium and/or printhead assembly are moved relative to each other, the drops can be precisely deposited on the media to form particular text and graphic images.

One difficulty faced by fluid inkjet systems is partially or completely blocked inkjets. Partially or completely blocked inkjets may be caused by a number of factors including contamination from dust or paper fibers, dried ink, etc. In addition, when the solid ink printer is turned off, the ink that remains in the printhead can freeze. When the printer is turned back on and warms up, the ink melts and air that was once in solution in the ink emerges to form air bubbles or air pockets. This air may partially or completely block the fluid path through one or more inkjets and cause missing, undersized or misdirected ink drops on the recording media.

Some partially or completely blocked inkjets may be recovered by performing printhead maintenance. Printhead maintenance generally includes pressurizing the space in a printhead to force ink through the ink pathways of a printhead. This forced ink flow clears contaminants, air bubbles, dried ink, etc. from the fluid paths in the printhead and some of the ink is expelled from the apertures onto the area of the aperture plate surrounding the apertures. A wiper is then swiped across the aperture plate to remove the ink from the aperture plate of the printhead. While the printhead maintenance may restore some inkjet ejectors, the purging action expels some ink that does not contribute to the recovery of weak or missing jets.

Printheads may be arranged in rows within a printer to print across a width of the recording medium. Previously known purging methods allow individual printheads to be selected for maintenance so printheads in which no inoperative or malfunctioning inkjets were detected can skip a printhead maintenance procedure. In this manner, ink can be better preserved. The printers using these purging methods, however, require each printhead to have a separate wiper. A separate wiper is necessary for each printhead because wiping inkjets that do not have ink present on the front face of the printhead may damage the inkjets. Apparently, the presence of the ink helps reduce the friction caused by wiping the face plate and this friction is thought to be the cause of the inkjet damage that may occur during wiping. Improving printhead maintenance procedures and systems to enable the use of fewer wipers without subjecting each printhead to a purging operation is a desirable goal.

SUMMARY

A printer has been developed that enables a wiper to clean ink from multiple printheads without requiring each wiped printhead to undergo a purging operation. The printer includes a first ink reservoir configured to store liquid ink, a second ink reservoir configured to store liquid ink, a first plurality of inkjet ejectors operatively connected to the first ink reservoir to enable the first plurality of inkjet ejectors to eject ink received from the first ink reservoir, a second plurality of inkjet ejectors operatively connected to the second ink reservoir to enable the second plurality of inkjet ejectors to eject ink from the second ink reservoir, a pressure source operatively connected to the first ink reservoir and the second ink reservoir, the pressure source being configured to pressurize ink in the first ink reservoir to one of a first and second pressure and to pressurize ink in the second ink reservoir to one of the first and the second pressure, a first wiper positioned at a location that enables the first wiper to contact a face of the first plurality of inkjet ejectors, a second wiper positioned at a location that enables the second wiper to contact a face of the second plurality of inkjet ejectors, a single actuator operatively connected to the first wiper and the second wiper to move at a same time the first wiper into contact with the first plurality of inkjet ejectors and to move the second wiper into contact with the face of the second plurality of inkjet ejectors, and a controller operatively connected to the single actuator and the pressure source, the controller being configured to operate the pressure source to apply the first pressure to the first ink reservoir for a first period of time and then apply the second pressure to the first ink reservoir and the second ink reservoir for a second period of time and to operate during the second period of time the single actuator to move the first wiper into contact with the face of the first plurality of inkjet ejectors and to move the second wiper into contact with the face of the second plurality of inkjet ejectors to enable the first and the second wipers to be moved across the faces of the first plurality of inkjet ejectors and the second plurality of inkjet ejectors while the pressure source applies the second pressure to the first plurality of inkjet ejectors and the second plurality of inkjet ejectors during the second time period.

A method of operating a printing device has been developed that enables multiple printheads to be wiped by a single wiper without requiring each printhead to undergo a purging operation. The method includes applying a first pressure during a first time period to a first ink reservoir to urge ink through a first plurality of inkjet ejectors and onto a face of the first plurality of inkjet ejectors, applying a second pressure during a second time period following the first time period to the first ink reservoir and to a second ink reservoir to form a convex meniscus of ink at apertures of the first plurality of inkjet ejectors and at apertures of a second plurality of inkjet ejectors during the second time period, the second pressure being less than the first pressure, and operating a pair of wipers with a single actuator to engage a portion of the apertures of the first plurality of inkjet ejectors and a portion of the apertures of the second plurality of inkjet ejectors during the second time period.

Another printer has been developed that enables a wiper to clean ink from multiple printheads without requiring each wiped printhead to undergo a purging operation. The printer includes a plurality of ink reservoirs, each ink reservoir being configured to store liquid ink, a plurality of printheads, each printhead in the plurality of printheads being operatively connected to only one reservoir in the plurality of ink reservoirs to enable each printhead to be supplied ink from one of the ink reservoirs in the plurality of ink reservoirs independently of the other printheads, and each printhead having a face from which the printhead ejects ink, a pressure source operatively connected to the plurality of ink reservoirs, the pressure source being configured to pressurize selectively each ink reservoir to one of a first and second pressure to enable selected ink reservoirs in the plurality of ink reservoirs to be pressurized to the first pressure while other ink reservoirs in the plurality of ink reservoirs are pressurized to the second pressure, a plurality of wipers, each wiper being configured to engage the face of only one printhead in the plurality of printheads, a single actuator operatively connected to the plurality of wipers, the single actuator being configured to move each wiper in the plurality of wipers into contact with the face of each printhead in the plurality of printheads, and a controller operatively connected to the actuator and the pressure source, the controller being configured to operate the pressure source to apply during a first time period to selected ink reservoirs in the plurality of ink reservoirs the first pressure to urge ink from the inkjet ejectors in the printheads to which the first pressure is being applied and to apply during a second time period the second pressure to each printhead in the plurality of printheads to form a convex meniscus of ink at the face of each printhead in the plurality of printheads and to operate the single actuator to move each wiper in the plurality of wipers into contact with the face of each printhead in the plurality of printheads during the second time period.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
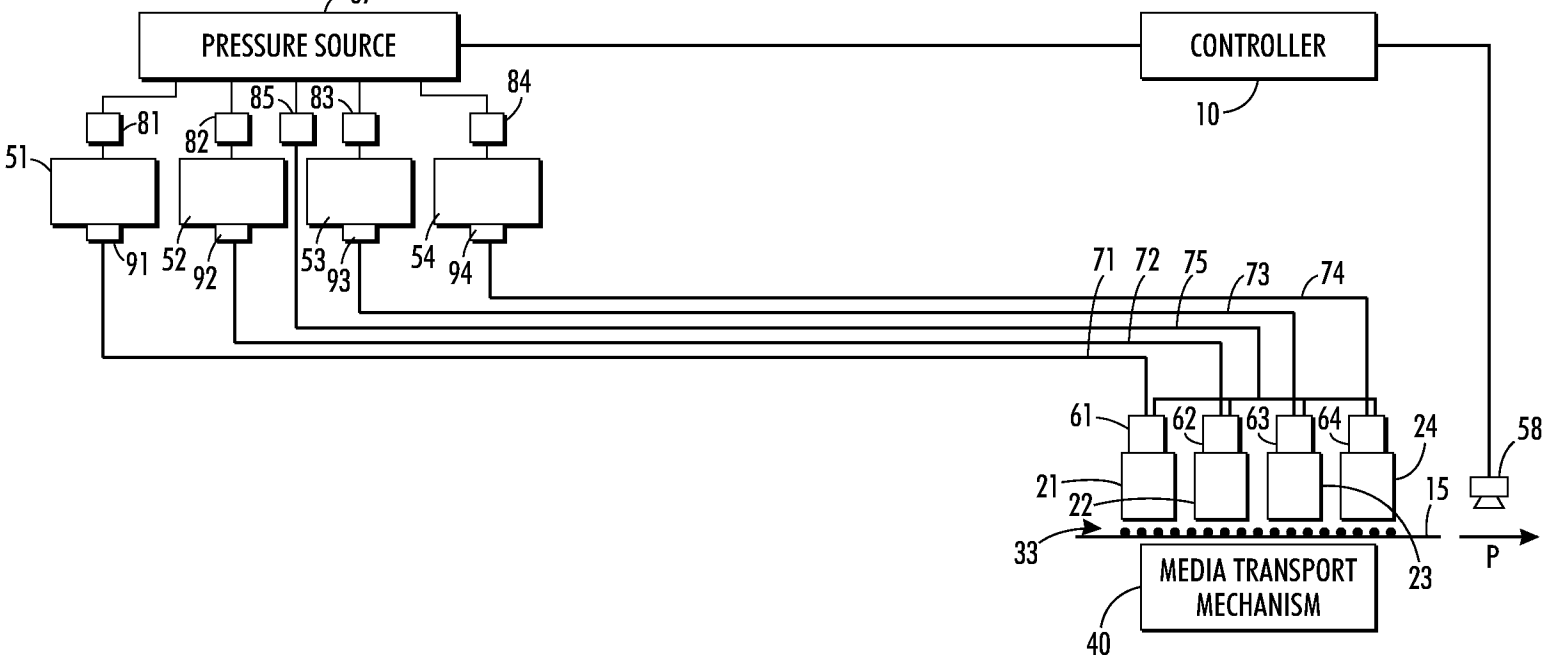
FIG. 1 is a schematic block diagram of an embodiment of an inkjet printing apparatus that includes on-board ink reservoirs.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is printed, moves through the imaging device as it passes the printhead(s). The cross-process direction, along the same plane as the image receiving surface, is substantially perpendicular to the process direction.

Figure 2:
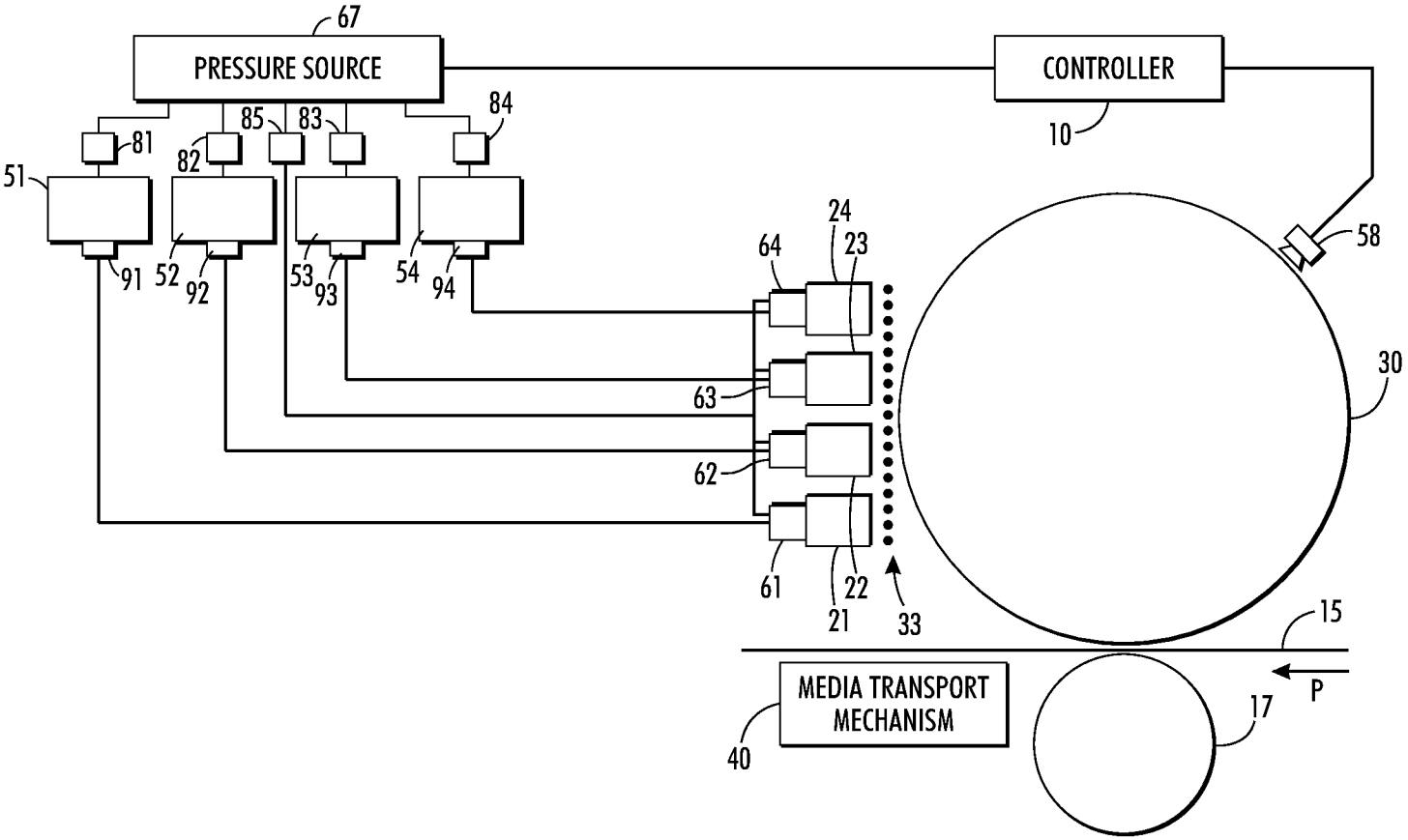
FIG. 2 is a schematic block diagram of another embodiment of an inkjet printing apparatus that includes on-board ink reservoirs.

FIGS. 1 and 2 are schematic block diagrams of an embodiment of an inkjet printing apparatus that includes a controller 10 and printheads 21, 22, 23, 24 that may include a plurality of inkjet drop ejectors for ejecting drops of ink 33 either directly onto a print output medium 15 or onto an intermediate transfer surface 30. A print output medium transport mechanism 40 may move the print output medium in a process direction P relative to the printheads 21-24. The printheads 21-24 receive ink from a plurality of on-board ink reservoirs 61, 62, 63, 64, which are attached to the printheads 21-24, respectively. The on-board ink reservoirs 61-64 receive ink from a plurality of remote ink containers 51, 52, 53, 54 via respective ink supply channels 71, 72, 73, 74.

Although not depicted in FIG. 1 or 2, the inkjet printing apparatus includes an ink delivery system for supplying ink to the remote ink containers 51-54. In one embodiment, the ink utilized in inkjet printing apparatus is a "phase-change ink " Phase-change ink is ink that is substantially solid at room temperature and substantially liquid when heated to a phase change ink melting temperature for jetting onto an imaging receiving surface. Accordingly, the ink delivery system comprises a phase change ink delivery system that has at least one source of at least one color of phase change ink in solid form. The phase change ink delivery system also includes a melting and control apparatus (not shown) for melting the solid form of the phase change ink into a liquid form and delivering the melted ink to the appropriate remote ink container. The phase change ink melting temperature may be any temperature that is capable of melting solid phase change ink into liquid or molten form. In one embodiment, the phase change ink melting temperate is approximately 90° C. to 140° C. In alternative embodiments, however, any suitable marking material or ink may be used including, for example, aqueous ink, oil-based ink, UV curable ink, or the like and may or may not need to be melted to achieve the correct properties for jetting.

The remote ink containers 51-54 are configured to release melted phase change ink held in the containers to the on-board ink reservoirs 61-64. The on-board ink reservoirs 61-64 and the remote ink containers 51-54 are configured in one embodiment to contain melted solid ink and are heated. In one embodiment, the remote ink containers 51-54 may be selectively pressurized, for example, by compressed air that is provided by a pressure source 67 via a plurality of valves 81, 82, 83, and 84. The flow of ink from the remote containers 51-54 to the on-board reservoirs 61-64 may be under pressure or by gravity, for example. Output valves 91, 92, 93, 94 may be provided to control the flow of ink to the on-board ink reservoirs 61-64. The pressure source 67 may be configured to deliver air under pressure to the on-board ink reservoirs 61-64 at a plurality of different pressure levels. The plurality of pressure levels may be provided by using a variable speed air pump and/or by controlling valves 81-84 to bleed off pressure from the pressure supplied by the air pump until a desired pressure level is reached. As explained below, the plurality of pressure levels include at least a purge pressure and an assist pressure.

The on-board ink reservoirs 61-64 may be selectively pressurized, for example, by selectively pressurizing the remote ink containers 51-54 via valves 81-84 and pressurizing an air channel 75 via a valve 85. Alternatively, the ink supply channels 71-74 may be closed, for example, by closing the output valves 91-94, and the air channel 75 may be pressurized. The on-board ink reservoirs 61-64 may be pressurized to perform a cleaning or purging operation on the printheads 21-24, for example. The ink supply channels 71-74 and the air channel 75 may also be heated. The pressure supplied by pressure source 67 to the on-board reservoirs 61-64 is provided at a plurality of pressure levels including the purge pressure and the assist pressure. The on-board ink reservoirs 61-64 are vented to atmosphere during normal printing operation, for example, by controlling the valves 81-85 to vent the air channel 75 to atmosphere. The on-board ink reservoirs 61-64 may also be vented to atmosphere during non-pressurizing transfer of ink from the remote ink containers 51-54 (i.e., when ink is transferred without pressurizing the on-board ink reservoirs 61-64). Another embodiment of a direct to paper inkjet printing apparatus in which the method disclosed herein is used is disclosed in co-pending U.S. patent application Ser. No. 13/026,988, which is entitled "Test Pattern Less Perceptible To Human Observation And Method Of Analysis Of Image Data Corresponding To The Test Pattern In An Inkjet Printer" and which was filed on Feb. 14, 2011, the disclosure of which is hereby expressly incorporated in this document in its entirety by reference.

FIG. 2 is a schematic block diagram of an embodiment of an indirect inkjet printing apparatus that is similar to the embodiment of FIG. 1. Rather than directly printing on the media, however, the printheads 21-24 eject ink onto an image receiving member 30 and the ink image is subsequently transferred to media carried by the media transport mechanism 40. A transfix roller 17 selectively engages the image receiving member 30 in synchronization with the arrival of a print media to transfer the image printed on the image receiving member 30 to the print output medium 15.

Figure 3:
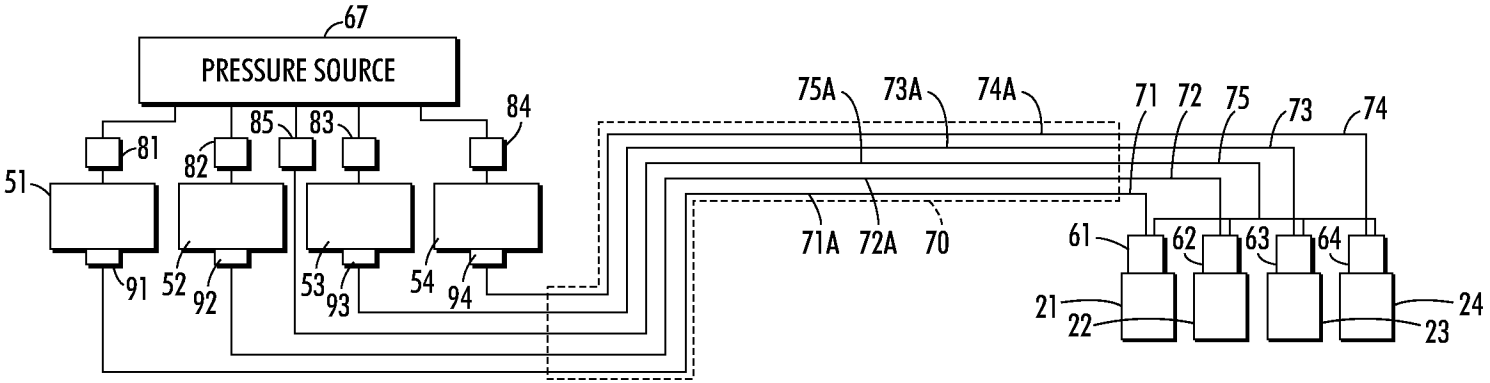
FIG. 3 is a schematic block diagram of an embodiment of ink delivery components of the inkjet printing apparatus of FIGS. 1 and 2.

As schematically depicted in FIG. 3, a portion of the ink supply channels 71-74 and the air channel 75 may be implemented as conduits 71A, 72A, 73A, 74A, 75A in a multi-conduit cable 70, which is shown in phantom in the figure. Also shown in FIG. 3, each printhead 21-24 receives ink from attached on-board ink reservoirs 61-64, respectively. Once pressurized ink reaches a printhead 21-24 via an ink supply channel 71-74, it is collected in the on-board reservoir 61-64. The on-board reservoir 61-64 is configured to supply ink to a plurality of inkjets in a jet stack (not shown) for each of the printheads. These inkjet ejectors are operated by a controller using image data to eject ink onto a print medium 15 (FIG. 1) or an intermediate transfer member such as image receiving member 30 (FIG. 2).

Figure 4:
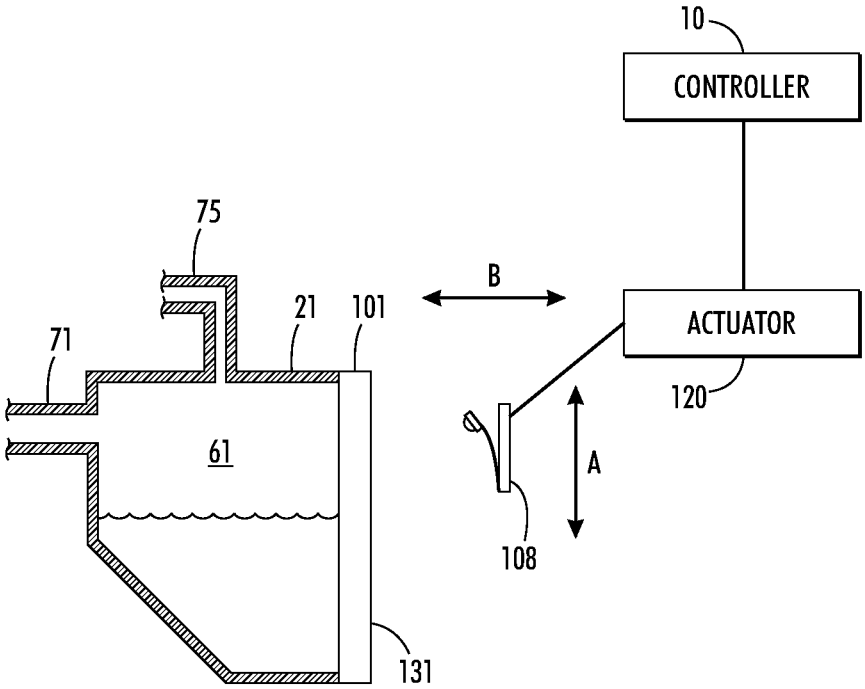
FIG. 4 is a simplified side cross-sectional view of an embodiment of a printhead.

FIG. 4 shows an embodiment of printhead 21, by way of example, including on-board reservoir 61 and jet stack 101. The description of FIG. 4 referring to printhead 21 also pertains to printheads 22-24 and their corresponding elements. The jet stack 101 can be formed in many ways, but in this example, it is formed of multiple laminated sheets or plates, such as stainless steel and polymer plates. Cavities etched into each plate align to form channels and passageways (not shown) that define the inkjets for the printhead 21. In one embodiment, the inkjets of printheads 21-24 may be aligned in the cross-process direction. In another embodiment, the inkjets of printheads 21-24 may be aligned in the process direction.

An outer plate of the jet stack 101 comprises the aperture plate 131 that includes a plurality of apertures (not shown) corresponding to each inkjet through which drops of ink 33 are ejected. During operation, ink from the on-board printhead reservoir 61 fills the ink manifolds, inlet channels, pressure chambers, and outlet channels of the inkjets and forms a convex meniscus (not shown) at each aperture prior to being expelled from the apertures in the form of a droplet. As used in this document, "convex meniscus of ink" refers to ink present at an aperture of an inkjet ejector that bulges outwardly away from the aperture of the inkjet ejector, yet remains in place at the aperture until the surface tension of the convex meniscus is broken. The meniscus of the melted ink is maintained at the apertures of the printhead 21 and prevented from leaking or drooling from the apertures by controlling the surface properties of the aperture plate 131 as well as the use of a slightly negative pressure, i.e., back pressure, to the ink inside the reservoir 61. As used herein, the term "drooling" refers to the emission or leakage of ink from one or more apertures of a printhead at any time other than when the inkjet aperture is actuated to emit a drop of ink The back pressure is usually in the range of −0.5 to −5.0 inches of water. Any suitable method or device may be used to provide the slight negative pressure required to maintain the ink at the apertures. For example, as is known in the art, the positioning of the on-board reservoir 61 with respect to the jet stack 101 and the dimensioning of the ink chambers and passageways in the on-board reservoir 61 and jet stack 101 of the printhead 21 may be selected to provide the requisite back pressure to pin the ink menisci at the apertures and to prevent ink from drooling from the apertures.

One difficulty faced by fluid inkjet systems is inkjet contamination, causing what is referred to herein as missing or defective jets. As used herein, the term "missing or defective jet" is used to refer to an inkjet that is partially or completely blocked as a result of air bubbles within the printhead or contamination, such as paper dust and debris particles, in and around the corresponding apertures in the aperture plate. In order to recover from and/or prevent contaminated jets, imaging devices may include a maintenance system for periodically performing a maintenance procedure on the printhead (s). Maintenance procedures typically include purging ink through apertures of the printhead, also referred to as burping, and wiping the aperture plate to remove ink and debris from the surface of the aperture plate. In order to purge ink from the printhead 21 of FIG. 4, a purge pressure may be applied to ink in the on-board reservoir 61 using the pressure source (i.e., air pump) 67 through an opening, or vent, operably coupled to the air channel 75 (FIGS. 1-3). As used herein, the term "purge pressure" refers to the pressure of air applied to ink in an on-board reservoir that is configured to urge ink from the reservoir through the inkjet ejectors and be released from the apertures in the aperture plate. Purge pressures are typically a few to several psi, and, in one embodiment, is approximately 4.1 psi. After ink is purged through the apertures of the printhead 21, a wiper blade 108 may be drawn across the aperture plate 131 to squeegee away any excess liquid phase change ink, as well as any paper, dust or other debris that has collected on the aperture plate 131.

The controller 10 operates an actuator 120 that enables the wiper blade 108 to be moved in the B direction with respect to the printhead 21 to engage the face of the printhead and enable a wiping operation and then retract the wiper from the face of the printhead. Another actuator, not shown, moves the wiper during a wiping procedure. As used herein, the term "wiping procedure" or "wiping" with respect to the aperture plate refers to the process of moving the wiper into contact with the aperture plate at a first location, e.g., above the apertures in the aperture plate, and drawing the wiper blade across the face of the aperture plate to a second location on the aperture plate, e.g., below the apertures in the aperture plate. To enable a wiping procedure, the actuator 120 operates the wiper blade 108 so that the wiper blade 108 may be moved toward and away from the aperture plate 131 along an axis B, which is substantially normal to the aperture plate 131, to move the wiper into and out of contact with the aperture plates 131. In addition, the other actuator enables relative movement of the wiper 108 along an axis A substantially parallel to the front surface of the aperture plate 131 to move the wiper 108 across the face of the aperture plate 131.

In previously known printing systems, each printhead had a corresponding wiper that was independently operated to move the wiper in the B direction shown in FIG. 4. This type of operation made the purging of a single printhead or selected printheads in a plurality of printheads possible because only those printheads that were purged were engaged for wiping. This arrangement, however, is expensive as it requires an actuator for the independent movement of each wiper with reference to the printhead engaged by the wiper. In the system and method described below, a single actuator is operatively connected to a plurality of wipers for the simultaneous movement of a plurality of wipers in the B direction. In order to prevent damage from a wiper engaging and wiping a printhead face that does not have ink on its face from a purging operation, the ink reservoirs supplying ink to printheads that need purging to clear inkjet ejectors are pressurized at an appropriate purging pressure and then all of the ink reservoirs are pressurized at an assist pressure that enables a convex meniscus of ink to form at the apertures of the inkjet ejectors of all of the printheads connected to the pressurized ink reservoirs. A single actuator can bring all of the wipers into engagement with the printheads for a wiping operation and retract all of the wipers once the wiping operation is finished. For those printheads that were not subjected to the purging pressure, the assist pressure still enables an amount of ink to be displaced from the bulges of ink from the inkjet ejectors onto the face of the printhead during the wiping operation that lubricates the face of the printhead and helps prevent damage to the printhead face.

Figure 5:
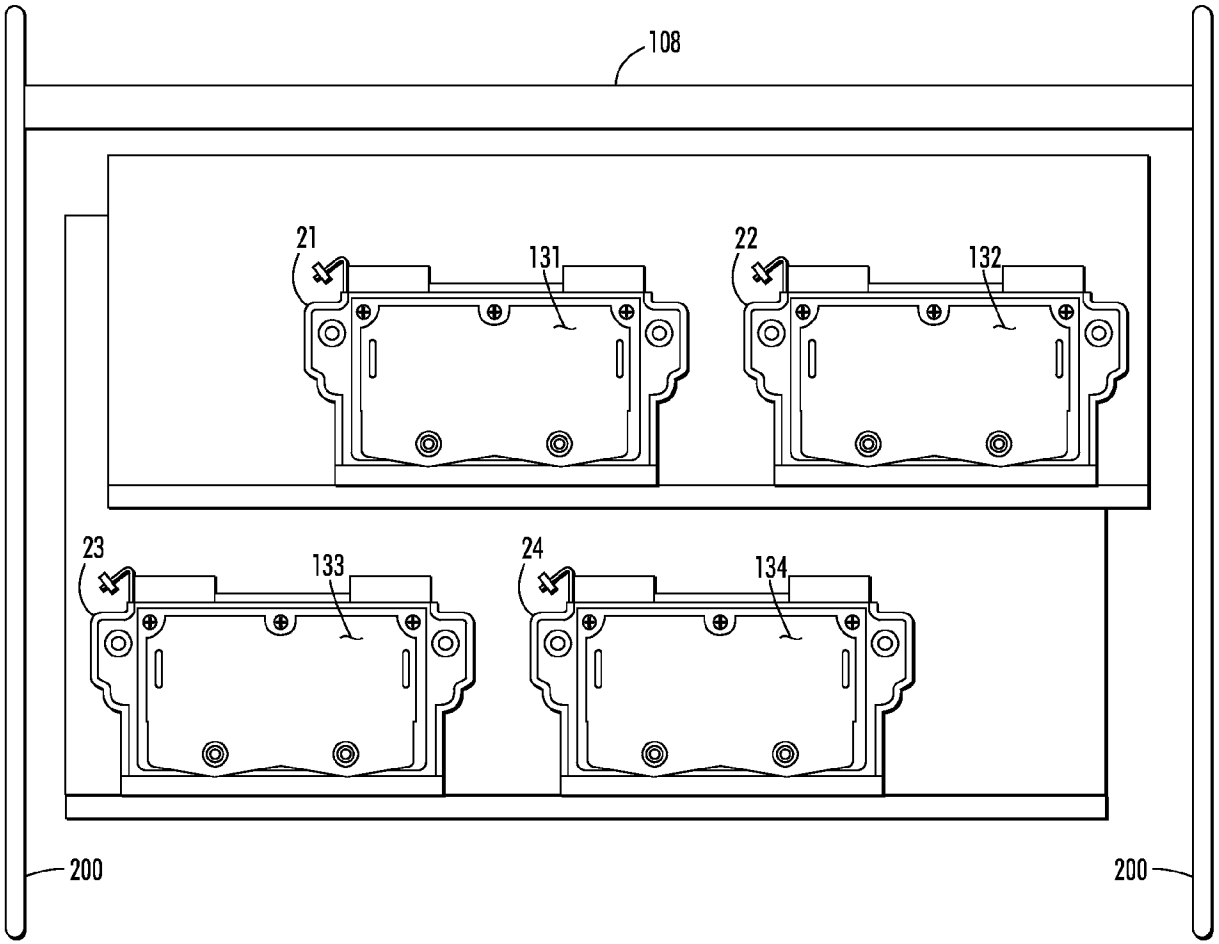
FIG. 5 is a front elevational view of a printhead system showing staggered printheads in two rows.

As shown in FIG. 5, the wiper blade 108 is located in a position that enables it to move across the face of the aperture plates 131-134 of multiple printheads in the configuration of printheads 21-24 shown in the figure. In an inkjet printing apparatus having an intermediate transfer member, such as image receiving member 30 shown in FIG. 2, the wiper blade 108 extends across the width of the image receiving member 30. In one embodiment, the wiper blade 108 is connected to parallel tracks 200. In one embodiment, the wiper blade 108 is connected to the parallel tracks 200 by a pin received in a slot, for example, or by any other structure that allows the wiper blade 108 to be moved by a single actuator before wiping the faces of the aperture plates 131-134 as the wiper moves along the tracks 200. In other embodiments, four independent wipers may be operatively connected to one another to enable a single actuator to enable the wipers to be moved into and out of engagement with the printheads for a wiping procedure on the aperture plates 131-134.

The wiper 108 may be moved into and out of contact with the aperture plates 131-134 at a plurality of locations along the axis A to enable dabbing procedures. As used herein, the term "dabbing" or "dabbing procedure" refers to the process of moving the wiper blade into and out of contact with an aperture plate of a printhead in an effort to remove debris particles from the wiper blade. Wiper dabbing may be performed at any suitable time such as before and/or after a wiping procedure. The wiper blade 108 may be dabbed against the aperture plates 131-134 at any suitable location on the aperture plates 131-134, such as below the apertures.

Previously known purging methods required that ink be purged through each inkjet of a printhead in which a missing or defective inkjet was detected. Often, however, printheads may have only one or a few contaminated jets at any given time. While purging ink through each inkjet aperture may be effective in recovering missing or defective inkjets, the ink mass moved through operational inkjets does not contribute to the recovery of the missing or defective inkjets and is not effectively used. As an alternative to purging each inkjet of a printhead during a purge procedure, some prior maintenance systems use selective maintenance of inkjets to increase the efficiency of jet recovery for a given amount of purged ink In one system, only those inkjets in a printhead that are contaminated are purged and only the portions of the aperture plates near those inkjets that are purged are wiped. However, this type of selective wiping requires a selective purge pressure to be applied to an ink reservoir in a printhead, a wiper for each printhead, and an actuator for movement of the wiper to contact only particular locations on the aperture plate. A wiper and actuator for each printhead for movement in the B axis is required because wiping inkjets, which have not had the purge pressure applied to them, may damage the inkjet ejectors in the printhead. This damage may arise from the lack of ink at the apertures that increases friction between the wiper and the aperture plate. Additionally, missing or defective inkjets are not likely to be aligned on different printheads in the cross-process direction so the benefit of precise wiper manipulation is lost as a greater area must be swept on the multiple printheads to cover the missing and defective inkjets on each printhead. Accordingly, the method and system presented in this document proposes applying a purge pressure to those printheads with missing and/or defective inkjets and then applying a different, lighter pressure to all of the printheads to be wiped to enable ink to be present on the face of all of the pressurized printheads during the time of the wiping procedure. This type of operation enables the printhead faces to be wiped at substantially the same time with less ink loss than would be experienced if all of the printheads were pressurized to the full purge pressure. Consequently, the printheads can be properly maintained without requiring a separate wiper and wiper control for each printhead in a printer. Thus, the cost of a maintenance system in a printer is reduced.

To provide an appropriate amount of ink to lubricate the aperture plates 131-134 for wiping without wasting ink by purging a printhead without missing or defective inkjets, the pressure source 67 is configured to deliver a low pressure assist (LPA) pressure to the on-board reservoir 61 of the printhead 21. As used herein, an LPA is a pressure applied to the ink in an on-board reservoir at a level that forms a convex meniscus of ink at the apertures of the inkjet ejectors in the printhead before the wiping procedure. The LPA may be any suitable pressure level capable of forming a convex meniscus of ink at the apertures. In one embodiment, the suitable pressure level is in a range of about 0.5 inches of water to about 1.5 inches of water. The controller 10 operates the pressure source 67 to apply either the purge pressure or the LPA to the on-board reservoir 61.

In operation, the controller 10 determines which printheads have missing or defective inkjets. The controller operates the pressure source 67 to apply a pressure to printheads 21-24 based on that determination. The controller 10 applies during a first time period a purge pressure to printheads 21-24 determined to have at least one missing or defective inkjet. The first time period corresponds to an appropriate amount of time for subjecting the inkjet ejectors to the purge pressure that is effective for clearing defective inkjet ejectors clogged by air bubbles or debris. The controller then operates the pressure source to terminate application of the purge pressure to the printheads having missing or defective inkjets and operates the pressure source to apply for a second time period an LPA to all of the printheads 21-24. The controller 10 also operates the actuator 120 to move the wiper blade 108 into engagement with the printhead faces to enable the wiping procedure.

Figure 6:
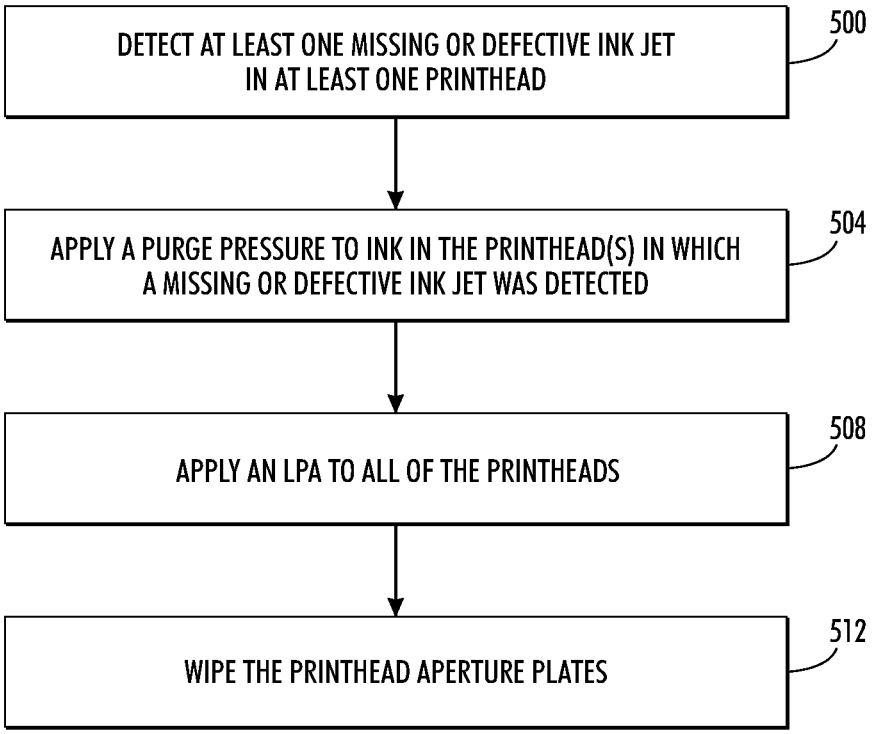
FIG. 6 is a flowchart of a method for applying purge pressure or an LPA to a printhead such as the printhead of FIG. 4.

FIG. 6 is a flowchart of an embodiment of a method of selectively purging printheads that utilizes purge pressure and LPA to enable wiping of printheads having at least one missing or defective inkjet and printheads having no missing or defective inkjets with a single wiper blade or multiple wiper blades moved by a single actuator during one wiping procedure. The reader should note that as used in this document, the term "single wiper" refers to a mechanism that is configured for maneuvering either one wiper blade that extends across at least two printheads or at least two wiper blades in a substantially simultaneous motion with each wiper blade extending across only one printhead. The method of FIG. 6 begins with the detection of at least one missing or defective inkjet in at least one printhead in a plurality of printheads (block 500). Methods and systems for detecting missing or defective inkjets are known in the art. In one embodiment, missing or defective inkjets may be detected by printing test patterns, using an inline image sensor 58 to generate image data of the printed test pattern, and processing the image data. Alternatively, an image sensor external to the printer, such as a flatbed scanner, may be used to generate the image data of the printed test pattern and the image data processed by a processor outside of the printer. The missing or defective inkjet identifying information is then entered by an operator or communicated electronically to the printer.

Once at least one missing or defective inkjet has been detected, the controller operates the pressure source to apply a purge pressure for a first time period to the ink in the one or more printheads containing missing or defective inkjets (block 504). As mentioned, the purge pressure is configured to discharge ink through the apertures in an aperture plate of the printhead to recover the missing or defective inkjets. After a purge pressure is applied to the ink in the one or more printheads containing the missing or defective inkjets for a first period of time that enables the missing or defective inkjets to be recovered, an LPA is applied to the ink in all of the printheads in the plurality of printheads (block 508). As mentioned, the LPA is configured to form a convex meniscus of ink at the apertures. After the LPA has been applied to the ink in all of the printheads in the plurality of printheads, the controller operates a single actuator to move a single wiper into engagement with at least a portion of the apertures on the aperture plates of at least some of the printheads in the plurality of printheads (block 512). The single wiper is then operated to wipe the printheads in the plurality of printheads during a second time period in which the LPA is applied to the printheads in the plurality of printheads. For example, as the wiper 108 moves downwardly past the printheads 21-24 shown in FIG. 5, printheads 21 and 22 are wiped substantially simultaneously and then printheads 23 and 24 are wiped substantially simultaneously. Even though printhead 21 may have no missing or defective inkjets and printhead 22 may have missing or defective inkjets, this simultaneous wiping is able to occur without damage to the inkjet ejectors of printhead 21 because the LPA provides a sufficient amount of ink to lubricate the wiper as it moves downwardly across the aperture plate of printheads 21 and 22. Likewise, even if only one or none of the printheads 23 and 24 have missing or defective inkjets, the wiper can still continue its movement past those printheads because the LPA enables the wiper to wipe those printheads with an appropriate amount of friction between the wiper and the faces. In one embodiment, one wiper blade may be used to wipe all printheads on a print bar, all printheads using a common color of ink, or all printheads in the printing apparatus, for example. In this embodiment, the pressures in the printheads to be wiped are set, then the printheads are wiped, and the pressure removed from the printheads.

In one embodiment, the wiper blade may move across the aperture plate of one printhead at a time during the wiping procedure because each printhead is as wide as the imaging member. The wiper blade may move across a printhead having a missing or defective inkjet first, or the wiper blade may move across a printhead not having a missing or defective inkjet first. In an alternative embodiment, the wiper blade may move simultaneously across the aperture plates of more than one printhead to be wiped during the wiping procedure.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printer comprising:

a first ink reservoir configured to store liquid ink;

a second ink reservoir configured to store liquid ink;

a first plurality of inkjet ejectors operatively connected to the first ink reservoir to enable the first plurality of inkjet ejectors to eject ink received from the first ink reservoir;

a second plurality of inkjet ejectors operatively connected to the second ink reservoir to enable the second plurality of inkjet ejectors to eject ink from the second ink reservoir;

a pressure source operatively connected to the first ink reservoir and the second ink reservoir, the pressure source being configured to pressurize ink in the first ink reservoir to one of a first and second pressure and to pressurize ink in the second ink reservoir to one of the first and the second pressure;

a first wiper positioned at a location that enables the first wiper to contact a face of the first plurality of inkjet ejectors;

a second wiper positioned at a location that enables the second wiper to contact a face of the second plurality of inkjet ejectors;

a single actuator operatively connected to the first wiper and the second wiper to move at a same time the first wiper into contact with the first plurality of inkjet ejectors and to move the second wiper into contact with the face of the second plurality of inkjet ejectors; and a controller operatively connected to the single actuator and the pressure source, the controller being configured to operate the pressure source to apply the first pressure to the first ink reservoir for a first period of time and then apply the second pressure to the first ink reservoir and the second ink reservoir for a second period of time and to operate during the second period of time the single actuator to move the first wiper into contact with the face of the first plurality of inkjet ejectors and to move the second wiper into contact with the face of the second plurality of inkjet ejectors to enable the first and the second wipers to be moved across the faces of the first plurality of inkjet ejectors and the second plurality of inkjet ejectors while the pressure source applies the second pressure to the first plurality of inkjet ejectors and the second plurality of inkjet ejectors during the second time period.

2. The printer of claim 1 wherein the first pressure is greater than the second pressure.

3. The printer of claim 2 wherein the first pressure purges ink through the first plurality of inkjet ejectors and the second pressure forms a convex meniscus of ink at apertures of the first plurality of inkjet ejectors and at apertures of the second plurality of inkjet ejectors during the second time period.

4. The printer of claim 1 wherein the first plurality of inkjet ejectors is aligned with the second plurality of inkjet ejectors in a cross process direction.

5. The printer of claim 1 wherein the first plurality of inkjet ejectors is aligned with the second plurality of inkjet ejectors in a process direction.

6. The printer of claim 1 wherein the controller is further configured to operate the pressure source to apply the first pressure to the first ink reservoir in response to the controller detecting inoperative inkjet ejectors in the first plurality of inkjet ejectors.

7. The printer of claim 1 wherein the first wiper and the second wiper extend across a width of an imaging receiving member in the printer.

8. A method of conducting inkjet ejector maintenance in a printer comprising:

applying a first pressure during a first time period to a first ink reservoir to urge ink through a first plurality of inkjet ejectors and onto a face of the first plurality of inkjet ejectors;

applying a second pressure during a second time period following the first time period to the first ink reservoir and to a second ink reservoir to form a convex meniscus of ink at apertures of the first plurality of inkjet ejectors and at apertures of a second plurality of inkjet ejectors during the second time period, the second pressure being less than the first pressure; and operating a pair of wipers with a single actuator to engage a portion of the apertures of the first plurality of inkjet ejectors and a portion of the apertures of the second plurality of inkjet ejectors during the second time period.

9. The method of claim 8 further comprising:

moving one of wipers in the pair of wipers moves across the apertures of the first plurality of inkjet ejectors while the other wiper in the pair of wipers simultaneously moves across the face of the second plurality of inkjet ejectors.

10. The method of claim 8 wherein the first pressure is applied to the first ink reservoir in response to inoperative inkjet ejectors being detected in the first plurality of inkjet ejectors.

11. The method of claim 8 wherein the first plurality of inkjet ejectors is aligned with the second plurality of inkjet ejectors in a cross process direction.

12. The method of claim 8 wherein the first plurality of inkjet ejectors is aligned with the second plurality of inkjet ejectors in a process direction.

13. A printer comprising:

a plurality of ink reservoirs, each ink reservoir being configured to store liquid ink;

a plurality of printheads, each printhead in the plurality of printheads being operatively connected to only one reservoir in the plurality of ink reservoirs to enable each printhead to be supplied ink from one of the ink reservoirs in the plurality of ink reservoirs independently of the other printheads, and each printhead having a face from which the printhead ejects ink;

a pressure source operatively connected to the plurality of ink reservoirs, the pressure source being configured to pressurize selectively each ink reservoir to one of a first and second pressure to enable selected ink reservoirs in the plurality of ink reservoirs to be pressurized to the first pressure while other ink reservoirs in the plurality of ink reservoirs are pressurized to the second pressure;

a plurality of wipers, each wiper being configured to engage the face of only one printhead in the plurality of printheads;

a single actuator operatively connected to the plurality of wipers, the single actuator being configured to move each wiper in the plurality of wipers into contact with the face of each printhead in the plurality of printheads; and a controller operatively connected to the actuator and the pressure source, the controller being configured to operate the pressure source to apply during a first time period to selected ink reservoirs in the plurality of ink reservoirs the first pressure to urge ink from the inkjet ejectors in the printheads to which the first pressure is being applied and to apply during a second time period the second pressure to each printhead in the plurality of printheads to form a convex meniscus of ink at the face of each printhead in the plurality of printheads and to operate the single actuator to move each wiper in the plurality of wipers into contact with the face of each printhead in the plurality of printheads during the second time period.

14. The printer of claim 13 wherein the first pressure is greater than the second pressure.

15. The printer of claim 13 wherein the printheads in the plurality of printheads are arranged in a cross process direction.

16. The printer of claim 13 wherein the printheads in the plurality of printheads are arranged in a process direction.

17. The printer of claim 13 wherein the controller is further configured to detect inoperative inkjets in the printheads of the plurality of printheads and to select ink reservoirs for application of the first pressure that are operatively connected to a printhead in which the controller detected inoperative inkjets.

18. The printer of claim 13 wherein the wiper extends across a width of an imaging receiving member in the printer.

* * * * *